United States Patent [19]

Greaves

[11] 4,203,818

[45] May 20, 1980

[54] ELECTROLYSERS

[76] Inventor: Bruce B. Greaves, 3 Fishermans Close, Formby, Merseyside, L37 1XX, England

[21] Appl. No.: 37,368

[22] Filed: May 9, 1979

[30] Foreign Application Priority Data

May 17, 1978 [GB] United Kingdom ..... 20020/78

[51] Int. Cl.[2] ..... C25B 8/00; C25B 15/08; C25B 1/34

[52] U.S. Cl. ..... 204/212; 204/268; 204/269

[58] Field of Search ..... 204/95, 212, 268, 269

[56] References Cited

U.S. PATENT DOCUMENTS

| | | | |
|---|---|---|---|
| 2,839,463 | 6/1958 | Vellas et al. | 204/212 |
| 3,119,759 | 1/1964 | Hoover | 204/212 |
| 3,196,095 | 7/1965 | Wadsworth | 204/149 |
| 3,649,508 | 3/1972 | Yokota et al. | 204/212 |
| 3,790,464 | 2/1974 | Greves | 204/212 |

FOREIGN PATENT DOCUMENTS

| | | | |
|---|---|---|---|
| 1278591 | 6/1972 | United Kingdom | 204/269 |
| 1399898 | 7/1975 | United Kingdom | 204/268 |

*Primary Examiner*—F. C. Edmundson
*Attorney, Agent, or Firm*—Gipple & Hale

[57] ABSTRACT

An electrolytic cell comprises an electrolyzing chamber having a pair of terminal electrodes located therein and adapted to be connected to the poles of a D.C. source. A plurality of bipolar electrodes in the form of parallel flat annular discs are located in the chamber between the terminal electrodes and are rotatable about a common central axis through their centers. An electrolyte inlet is located radially outwardly of the bipolar electrodes. In order to provide vigorous scouring of the bipolar electrodes with relative low fluid flows to the cell, the electrolyte inlet comprises one or more elongate slots formed in the cylindrical wall of the chamber and extending in a direction generally perpendicular to the planes containing the bipolar disc electrodes.

20 Claims, 9 Drawing Figures

-FIG.1-

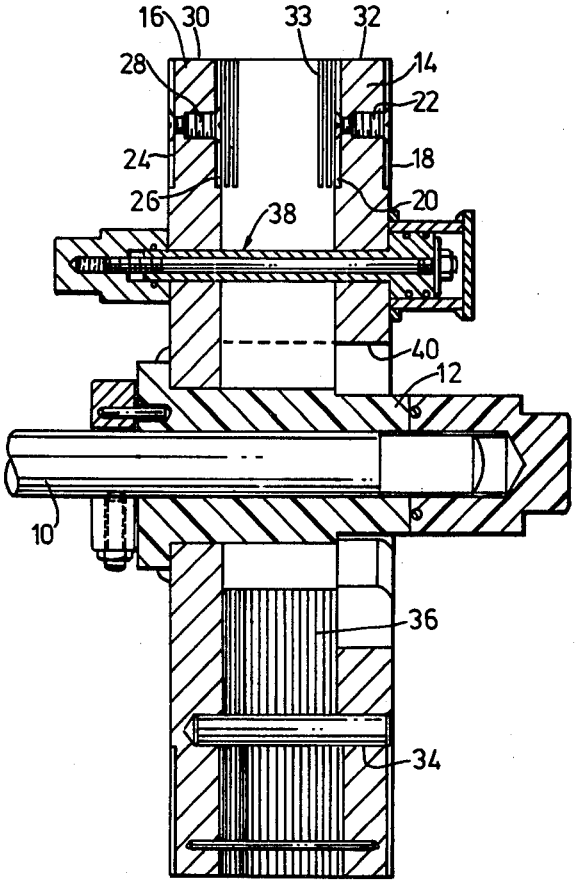
·—F I G.6.—·

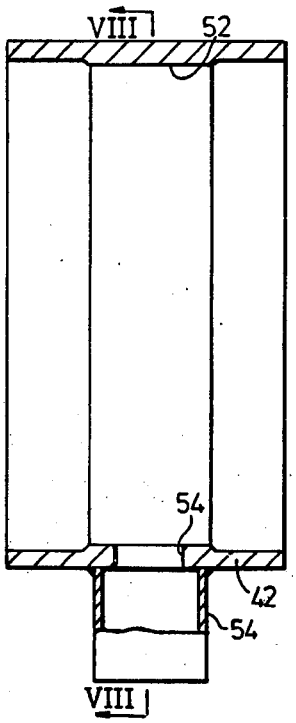
-FIG.7.-
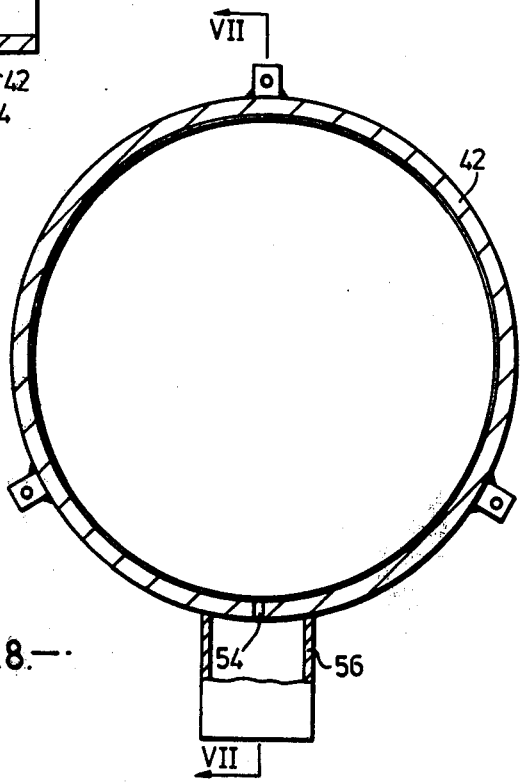
-FIG.8.-

ELECTROLYSERS

DESCRIPTION

The present invention relates to electrolytic cells and in particular to electrolysers for the continuous electrolysis of sea water, for example sea or esturaine water.

It is well known that when an electric current is passed through sea water between two suitable metallic electrodes, migration of the various free ions in the solution occurs. CI− ions and OH− ions move to the anode and Na+ and H+ ions move to the cathode. If the anodic and cathodic regions are not separated, the reaction products are free to react with each other producing sodium hypochlorite solution and hydrogen gas.

In the case of sea water, however, other salts are of course present, particularly the salts of magnesium. There thus results a comparatively high concentration of magnesium ions. Since magnesium hydroxide has a low solubility product, it is precipitated as a suspension of fine particles. This suspension tends to agglomerate in a deposition of magnesium hydroxide on the surface of the cathode electrodes in the electrolyser which adheres to the latter surface and inhibits the electrolysing reaction. If the agglomeration of particles adhering to the surface of the cathode electrodes is allowed to build up to such an extent that bridging of the anode and cathode electrodes occurs, the cell will break down completely and corrosion of the electrodes will occur.

In my prior U.S. Pat. No. 3,790,464, an arrangement for avoiding this problem is described in which an electrolytic cell comprises an electrolysing chamber having a pair of terminal electrodes located therewithin which are adapted to be connected to the poles of a D.C. source. A plurality of bipolar electrodes in the form of parallel annular discs are located in the chamber between the terminal electrodes so as to be rotatable about a common central axis through their centres. The chamber has an electrolyte inlet located radially inwardly of the bipolar electrodes and an electrolyte outlet located radially outwardly of the bipolar electrodes whereby electrolyte has to flow generally radially outwardly relative to the bipolar electrodes when passing between the inlet and outlet. By virtue of this arrangement, fluid passing from the inlet to the outlet is carried around to a certain extent by the rotating bipolar electrodes, so that insoluble particles in the electrolyte are subjected to a centrifuging action and are projected radially outwardly towards the outlet.

A problem in practice with the latter arrangement is that the outermost electrodes are necessarily disposed at their radial side surfaces, and all of the electrodes are disposed at their peripheral surfaces, adjacent to fixed walls of the electrolysing chamber with the result that frictional forces in the surrounding water have to be overcome to rotate the electrodes. Now in order to achieve the centrifugal effect necessary to keep the electrodes clear of deposits, the electrodes have to be rotated relatively quickly with the result that an intolerably high power has to be expended to overcome the latter frictional forces in rotating the electrodes.

It is an objective of the present invention to provide an electrolysing system in which the rotating electrodes can be kept substantially free from deposits without the necessity for high speed rotation of the rotating electrodes.

In this specification and the claims appended thereto, the term "bipolar electrode" of an electrolytic cell is to have its accepted meaning commonly used in the art, namely an intermediate cell electrode without metallic connection with the current supply, one surface of which acts as an anode and the opposite surface as a cathode when an electric current is passed through the cell from between two, outer "terminal electrodes".

In accordance with the present invention, there is provided an electrolytic cell comprising an electrolysing chamber, a pair of terminal electrodes located within the chamber and adapted to be connected to the poles of a D.C. source, a plurality of bipolar electrodes in the form of parallel flat annular discs which are located in the chamber between the terminal electrodes and which are rotatable about a common central axis through their centres, the cell having an electrolyte inlet located radially outwardly of the bipolar electrodes and comprising at least one elongate slot extending in a direction generally perpendicular to the planes containing said bipolar disc electrodes.

The invention is described further hereinafter, by way of example, with reference to the accompanying drawings, in which:

FIG. 6 is a diagrammatic, partially sectioned view, to an enlarged scale, of the cell rotor;

FIG. 7 is a sectional view of the cell casing on the line VII—VII of FIG. 8;

FIG. 8 is a sectional view of the cell casing on the line VIII—VIII of FIG. 7.

Figure 1:
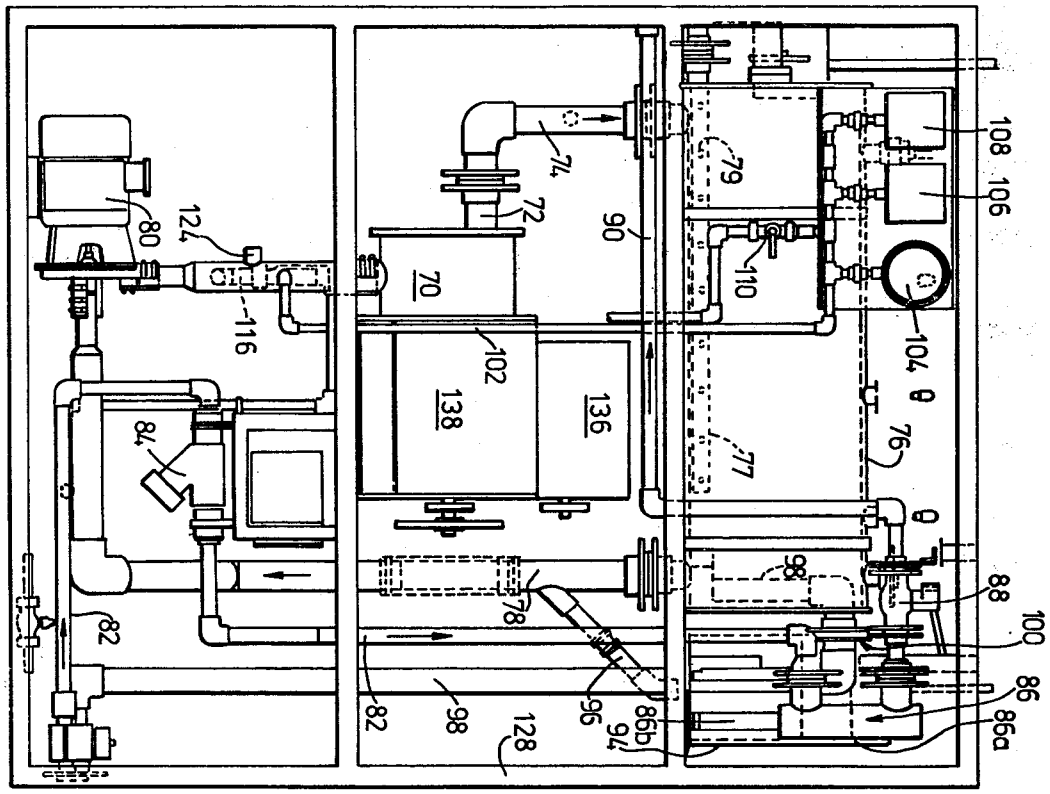
FIG. 1 is a side elevation of one embodiment of an electrolysing apparatus incorporating the present invention.
Figure 2:
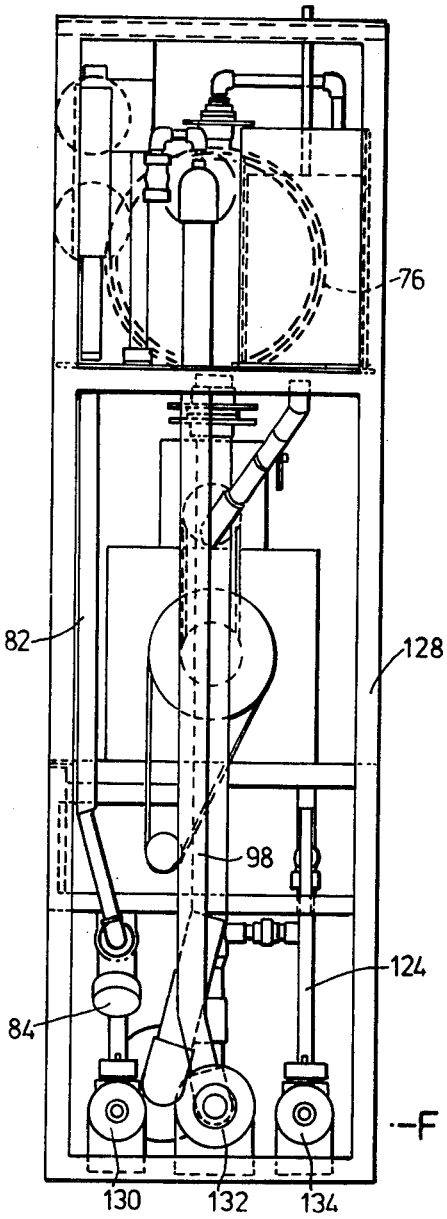
FIG. 2 is an end elevation of the apparatus of FIG. 1, viewed from the right of FIG. 1.
Figure 3:
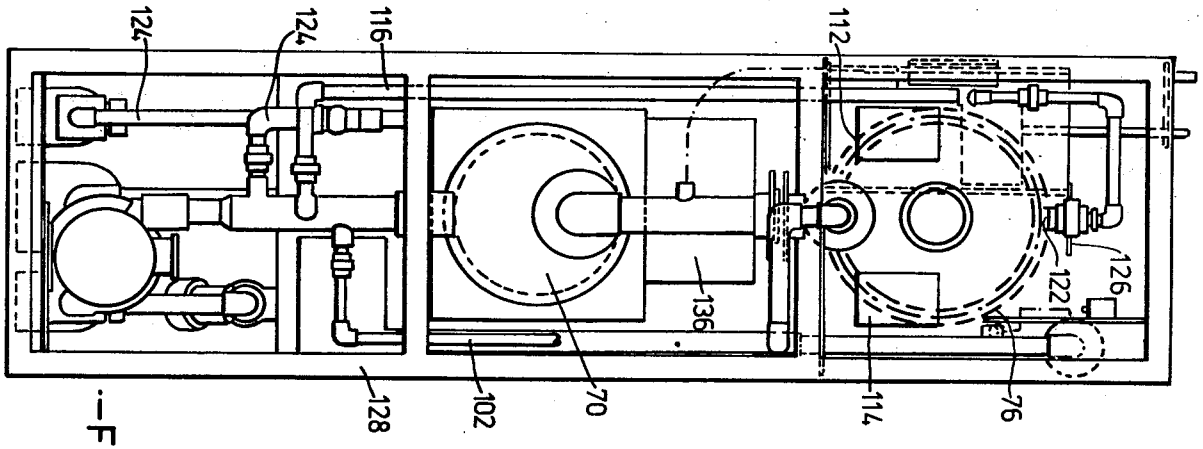
FIG. 3 is an end elevation of the apparatus of FIG. 1, viewed from the left of FIG. 1.
Figure 4:
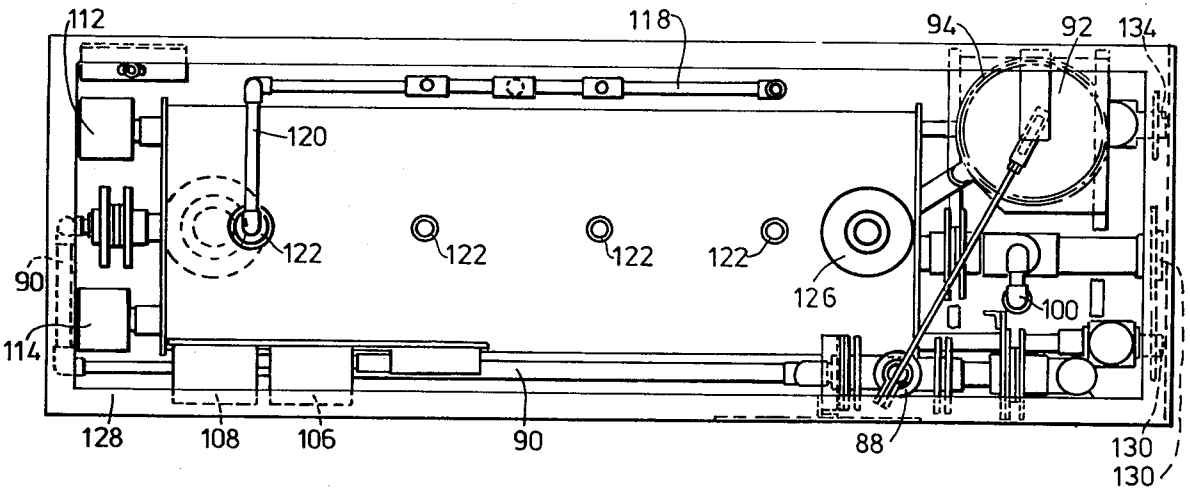
FIG. 4 is a plan view of the apparatus of FIG. 1.

With reference to FIGS. 5 to 8, the cell of the illustrated embodiment comprises a stainless steel shaft 10 carrying a PVC boss 12 on which are mounted a pair of spaced parallel annular discs 14,16 made of an electrically insulating material. The disc 14 has a pair of metal, annular disc-like electrodes 18,20 recessed into its two side surfaces, respectively, these electrodes being electrically interconnected by means of a screw fitting 22 which passes through the insulating disc 14. In the same manner, the disc 16 has a pair of metal, annular disc-like electrodes, 24,26 recessed into its two side surfaces, respectively, the electrodes 24,26 being electrically interconnected by means of a screw fitting 28. The screw fitting may, for example, be made of titanium. It will be noted that the outer peripheral edges of the metal disc electrodes lie flush with the outer peripheral surface 30,32 of the insulating discs 16,14. Mounted between the disc electrodes 20 and 26 are a plurality, in this case sixteen, of further annular metallic disc electrodes 33 which are of exactly the same radial dimensions as the electrodes 20 and 26 and which are all electrically isolated from one another by being supported by a plurality of axially directed rods 34 and separated by a plurality of disc-like insulating spacers (not shown). Disposed parallel to and immediately radially inwardly of each metal electrode 33, is a respective annular disc 36 of electrically insulating material, the discs 36 being supported on two or more axially directed insulated rods such as that shown at 34 in FIG. 6. The radially inner ends of the discs 36 terminate at the level of the outer periphery of a plurality of arcuate apertures 40 in the disc 14 which serve as a hypochlorite outlet from the cell as described further below.

The elements as so far described are keyed to the shaft 10 so as to rotate therewith, in operation of the apparatus, within a housing defined basically by a cylindrical casing 42 (see particularly FIGS. 7 and 8) mounted between parallel end plates 44,46 and 48, again of electrically insulating material, which are clamped together by means of a plurality of tie bars 50. The cylindrical casing 42 is formed such that a central portion 52 of its inner peripheral surface projects slightly inwardly and has an axial dimension corresponding to the axial length of the assembly comprising the discs 24, 30, 26, 33, 20, 32 and 18, the radial spacing between said surface portion 52 and the latter discs being minimal.

Figure 5:
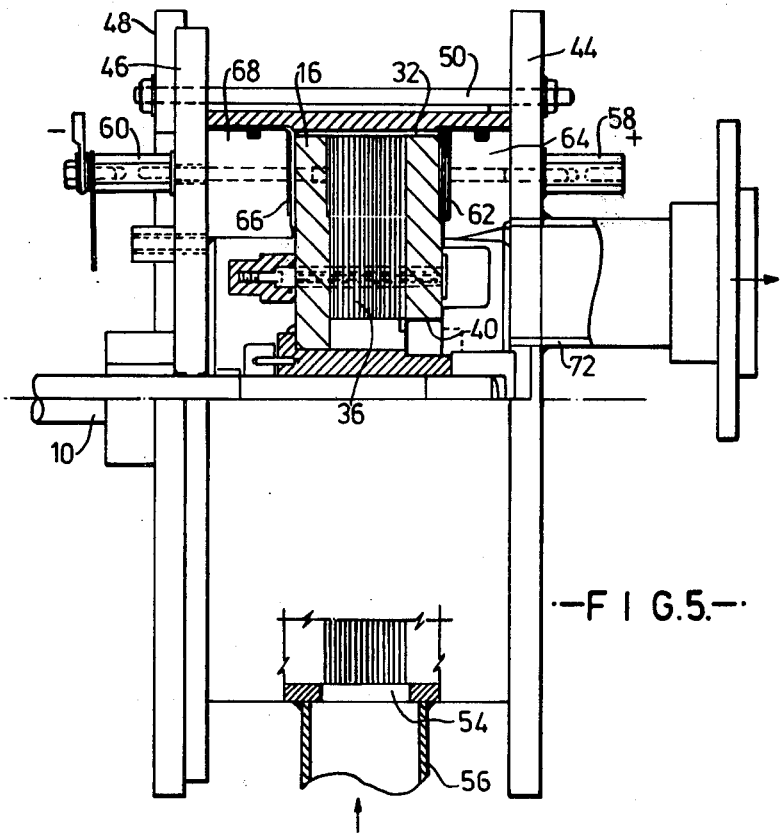
FIG. 5 is a diagrammatic, partially sectioned view, to a different scale to FIGS. 1 to 4, of the electrolysing cell of the apparatus.

As best seen at the bottom of FIG. 5 and in FIGS. 7 and 8, the cylindrical casing contains a straight-sided slot 54 of relatively small dimension (e.g. 3 m.m.) in the circumferential direction of the casing but of length, in a direction parallel to the rotor axis, equal to the axial distance occupied by the metallic disc electrodes 33, i.e. the distance from the disc 26 to the disc 20 (FIG. 6). This slot 54 provides the fluid inlet to the cell and communicates with inlet pipework 56. It will be appreciated that the angular area of the metallic disc electrodes 33 to which the input fluid is applied is small so that only a relatively slow flow into the cell is required to have a relatively high scouring effect on the electrodes at the region of entry to the cell for the purpose of keeping them free from particle deposition.

Electric current is supplied to the cell by means of an anode terminal 58 carried by the plate 44 and a cathode terminal 60 carried by the plate 46, the terminal 58 being connected to a further, fixed annular electrode 62 (FIG. 5) which is carried on an insulating boss 64 and whose left hand surface is platinised, the terminal 60 being connected to a further, fixed electrode 66 carried on an insulating boss 68. The fixed electrodes 62 and 66 are of the same radial dimensions as, and spaced closely to, the adjacent rotary electrodes 18 and 24. In the manner explained in my previous U.S. Pat. No. 3,790,464, the discs 33 are all of titanium with one surface platinised, all the platinised surfaces being arranged in this case, to face to the left as viewed in FIG. 6. In the same manner, the electrodes 18,20,24 and 26 are of titanium, the left hand surfaces of the electrodes 20 and 24 being platinised. It should be noted that coatings other than platinum can be used. For example, coatings of platinum/indium or $RuO_2$ can be used.

By virtue of this arrangement, the metallic discs act as electrodes of the "bipolar type" in that one side of each disc 33 functions as an anode and the other side functions as a cathode, only the outer two discs 62 and 66 of the cell as a whole being directly connected to the voltage supply. Electrons enter electrolyte in the cell through the left hand disc connected to the negative pole of the source and are transferred in the form of ions to the adjacent disc 24 carried by the insulating disc 16. The discs 24 and 26 act as a single bipolar electrode so that the disc 26 acts as a cathode and ions leave this disc to enter the extreme left hand disc 33 whose left hand platinised surface acts as an anode and whose right hand titanium surface acts as a cathode. In this way the electrons pass through all of the disc electrodes and return to the source via the extreme right hand electrode 62 connected to the positive pole.

By virtue of the passage of the current through the sea water electrolyte in the cell, an electrolytic reaction takes place, the principal features of which are that the sodium and chloride ions of the sodium chloride in the water are released at the cathodes and anodes, respectively. The sodium immediately reacts with the water to form sodium hydroxide and gaseous hydrogen. The chlorine immediately combines with the sodium hydroxide at the cathode to form sodium hypochlorite. No gaseous chlorine is released at any stage so that the cell is inherently safe. The main products of the cell during electrolysis are thus sodium hypochlorite and hydrogen gas. As explained further below, the hydrogen is arranged to be released and the dehydrogenated hypochlorite is recirculated through the cell until a required concentration is obtained. The remainder of the system described hereinafter is concerned with the control and recirculation of the sea water through the cell and of the hypochlorite and hydrogen so formed.

Referring now to FIGS. 1 to 4, the cell is indicated by the reference numeral 70 and has an outlet pipe 72 which communicates via piping 74 with the bottom of a cylindrical dehydrogenation tank 76 disposed above the cell. Electrolyte is removed from the tank 76 adjacent its opposite end via piping 78 and is led, via an electric motor driven pump 80, to the input slot 54 of the cell via the piping 56. The latter arrangement provides the basic recirculation of the electrolyte between the tank and cell.

Sea water is led into the apparatus by piping 82 and passes via filter 84, a flow meter 86, a valve 88, and piping 90 to the tank 76. As indicated diagrammatically in FIG. 1, the sea water enters the tank 76 via a sparge pipe 77 which extends longitudinally along the base region of the tank and has laterally disposed apertures 79 through which the sea water escapes into the tank. The flow out of the sparge pipe 77 is thus generally initially horizontal to achieve advantageous flow characteristics within the tank. The flow meter 86 can simply comprise a conical piston (not shown) disposed in a vertical tube **86*a* through which the input sea water flows, the piston having a depending pointer which can be viewed in a transparent viewing portion 86*b* and whose vertical position is dependent upon the rate of sea water flow through the tube 86*a*. The valve 88 is conveniently of the ball-cock type and is operated by a wall 92 which floats in a float tank 94 disposed adjacent the tank 76 and connected to the piping 78 by way of a pipe 96. Thus, the fluid levels in the float tank and the main tank 76 are identical, the input flow of sea water being controlled by the valve 88** to maintain these levels at a predetermined value.

For safety purposes, the main tank 76 is provided with an overflow pipe 98 which extends downwardly into the tank to a point below the fluid level in the tank. To prevent syphoning of the fluid from the tank via the overflow pipe, an anti-syphoning device is contained in the pipe 98, for example at the location 100.

A pipe 102 is connected to the piping 56 downstream of the pump 80 to enable the fluid pressure at this point in the system to be monitored. For this purpose, the pipe 102 contains a visual pressure indicating gauge 104 and a pair of pressure switches 106,108, adapted to be responsive to the pressure being too high and too low, respectively. In the event that either of these switches is actuated, the system is arranged to be de-energised.

A stop cock 110 enables fluid to be extracted from the system via the pipe 102.

Further switches 112,114 (FIG. 3) are adapted to respond to the temperature of fluid in the tank 76 being too high or too low, respectively. On actuation, these switches can again be arranged to initiate shut down of the system.

A further pipe 116 leads from the piping 56 downstream of the pump 80 to a manifold pipe 118 adjacent the top of the tank 76, the manifold pipe being connected via pipes 120 (one only shown in FIG. 4) to a plurality (four in this instance) of spray nozzles 122 disposed in the top of the tank 76. By means of these nozzles 122, pressurized fluid from the pump can be sprayed onto the surface of the fluid in the tank 76. By this means, the build up of froth, foam and bubbles which would otherwise occur on the fluid surface in the tank 76 can be prevented.

A still further pipe 124 leads from the piping 56 downstream of the pump 80 for discharging hypochlorite from the system.

Hydrogen is vented from the top of the tank 76 via a connection 126.

The components and pipework described above are conveniently mounted on a metal framework indicated generally by the reference numeral 128. It will be noted that the system has only three main fluid connections for coupling to external piepwork, namely a sea water inlet valve 130 connected to the piping 82, an overflow outlet 132 connected to the piping 98 and a hypochlorite outlet valve 134 connected to the piping 124.

For rotating the rotor of the cell carrying the electrodes 18,20,33,26 and 24, the shaft 10 is connected to an electric motor drive 136 via a speed reducing gearbox 138 and drive belts (not shown). Advantageously, a centrifugal switch (not shown) is included in the drive for ensuring that the electrical supply is only connected to the cell when the rotor is being rotated at the correct speed.

In operation of the aforegoing system, electrolyte in the form of sea water is fed to the main tank 76 by way of the flow control valve 88 which maintains a predetermined level within the tank, leaving a free space between the fluid level and the top of the tank for containing hydrogen gas released from the electrolysed fluid returned to the tank from the cell via the piping 74. The surface of the fluid in the tank is continuously sprayed with fluid taken from immediately downstream of the pump 88 via the line 116 to prevent foam building up on the surface. The hypochlorite product of the system is then taken off via the line 124 and the valve 134.

Figure 9:
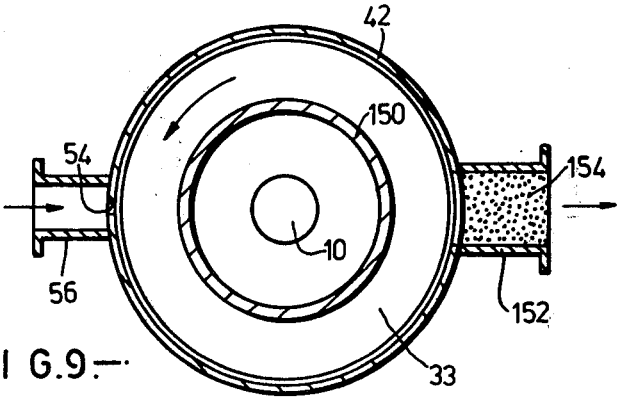
FIG. 9 is a diagrammatic sectional view through a modified embodiment having radial outflow from the cell.

In the above-described embodiment, the outflow from the cell 70 occurs in a direction parallel to the cell axis through the pipe 72. This is not essential, however, and it can be advantageous for the outflow to be radial like the inflow. In an alternative embodiment illustrated in FIG. 9, a cylindrical sleeve 150 of electrically insulating material, such as PVC is inserted immediately radially inwardly of the electrodes 33, the sleeve being fixed to the members 14,16 so as to rotate therewith. The insulating discs 36 are then redundant and are removed. The outlet from the cell is taken through a radially directed pipe 152 disposed, for example, diametrically opposite the inlet pipe 56. In order to reduce short circuiting of the electrodes through the fluid in the outlet pipe 152, a plurality of plates 154 of electrically insulating material, each disposed in the plane containing a respective one of the annular disc electrodes 33, are disposed in an end portion of the outlet pipe 154 so as to lie immediately downstream of the electrodes 33. By virtue of this arrangement, the electrical short circuit across the elctrodes 33 can be reduced considerably compared with the illustrated embodiment since in the latter case the short circuit extends through 360° around the inner peripheries of the insulating discs 36 whereas in the case of the radial outflow embodiment of FIG. 9 the length of the short-circuit is determined primarily be transverse dimensions of the outlet pipe 152. The resistance of the short circuit can be increased by increasing the length of the insulating plates along the outlet piping 152 in a direction away from the cell.

I claim:

1. In an electrolytic cell having an electrolysing chamber, a pair of terminal electrodes located within the chamber and adapted to be connected to the poles of a D.C. source, a plurality of bipolar electrodes in the form of parallel flat annular discs which are located in the chamber between the terminal electrodes and which are rotatable about a common central axis through their centres, and an electrolyte inlet located radially outwardly of the bipolar electrodes, the improvement in that said electrolyte inlet to the cell comprises at least one elongate slot extending in a direction generally perpendicular to the planes containing said bipolar disc electrodes.

2. An electrolytic cell according to claim 1, including a cylindrical casing defining said electrolysing chamber, said slot being formed in the circumferential wall of said cylindrical casing part of the cell.

3. An electrolytic cell according to claim 2, in which the outer peripheries of the bipolar electrodes lie immediately adjacent to the cylindrical surface containing said slot.

4. An electrolytic cell according to claim 1, 2 or 3, in which the length of the slot is substantially equal to the overall axial dimension of the plurality of bipolar electrodes.

5. An electrolytic cell according to claim 1, 2 or 3, in which said slot is disposed at or adjacent to the lowest point of said casing.

6. An electrolytic cell according to claim 1, including an electrolyte outlet located radially inwardly of at least parts of said bipolar electrodes.

7. An electrolytic cell according to claim 6, in which the electrolyte outlet is located eccentrically of the cell axis at a location above the level of the latter axis whereby to reduce the amount of free hydrogen gas trapped in the cell.

8. An electrolysing system incorporating an electrolytic cell according to claim 1, in which the cell has an electrolyte outlet which is connected to a dehydrogenation tank for the removal of hydrogen gas from the electrolyte.

9. An electrolysing system according to claim 8, including means for spraying liquid onto the surface of electrolyte in the dehydrogenation tank for preventing foaming of the electrolyte.

10. An electrolysing system according to claim 9, including a pump which pumps the electrolyte to said inlet and means for taking liquid for said spraying means from between the cell electrolyte input and said pump.

11. An electrolysing system according to claim 10, in which the electrolyte inlet to the pump is taken from a region of the dehydrogenation tank remote from the region of entry of electrolyte from the cell.

12. An electrolysing system according to claim 9, 10 or 11, including a sparge pipe disposed adjacent the base of the tank and via which raw input electrolyte is supplied to the dehydrogenation tank, the sparge pipe having a plurality of generally horizontally directed outlet apertures.

13. An electrolytic cell comprising a casing which has a cylindrical inner surface and which defines an electrolysing chamber, a pair of terminal electrodes located within the chamber and adapted to be connected to the poles of a D.C. source, a plurality of bipolar electrodes in the form of parallel flat annular discs which are located in the chamber between the terminal electrodes and which are rotatable about a common central aixs through their centres, the outer peripheries of the bipolar electrodes lying immediately adjacent to the cylindrical inner surface of said casing, the cell having an electrolyte inlet located radially outwardly of the bipolar electrodes and comprising at least one elongate slot disposed in said cylindrical wall surface of the casing extending in a direction generally perpendicular to the planes containing said bipolar disc electrodes, the length of said slot being substantially equal to the overall axial dimension of said plurality of bipolar electrodes.

14. An electrolytic cell according to claim 13, in which said slot is disposed at or adjacent to the lowest point of said casing.

15. An electrolysing system including an electrolytic cell comprising a casing which has a cylindrical inner surface and which defines an electrolysing chamber, a pair of terminal electrodes located within the chamber and adapted to be connected to the poles of a D.C. source, a plurality of bipolar electrodes in the form of parallel flat annular discs which are located in the chamber between the terminal electrodes and which are rotatable about a common central axis through their centres, the outer peripheries of the bipolar electrodes lying immediately adjacent to the cylindrical inner surface of said casing, the cell having an electrolyte inlet located radially outwardly of the bipolar electrodes and comprising at least one elongate slot disposed in said cylindrical wall surface of the casing and extending in a direction generally perpendicular to the planes containing said bipolar disc electrodes, the length of said slot being substantially equal to the overall axial dimension of said plurality of bipolar electrodes, an electrolyte outlet, a dehydrogenation tank for the removal of hydrogen gas from the electrolyte, means connecting the electrolyte outlet to the dehydrogenation tank, and means for spraying liquid onto the surface of electrolyte in the dehydrogenation tank for preventing foaming of the electrolyte.

16. An electrolysing system according to claim 15, including a pump which pumps the electrolyte to said inlet, and means for taking liquid for said spraying means from between the cell electrolyte input and said pump.

17. An electrolysing system according to claim 16, in which the electrolyte inlet to the pump is taken from a region of entry of electrolyte from the cell.

18. An electrolysing system according to claim 17, including a sparge pipe disposed adjacent to the base of the tank and via which raw input electrolyte is supplied to the dehydrogenation tank, the sparge pipe having a plurality of generally horizontally directed outlet apertures.

19. An electrolytic cell comprising a casing which has a cylindrical inner surface and which defines an electrolysing chamber, a pair of terminal electrodes located within the chamber and adapted to be connected to the poles of a D.C. source, a plurality of bipolar electrodes in the form of parallel flat annular discs which are located in the chamber between the terminal electrodes and which are rotatable about a common central axis through their centres, the outer peripheries of the bipolar electrodes lying immediately adjacent to the cylindrical inner surface of said casing, the cell having an electrolyte inlet located radially outwardly of the bipolar electrodes and comprising at least one elongate slot disposed in said cylindrical wall surface of the casing and extending in a direction generally perpendicular to the planes containing said bipolar disc electrodes, the length of said slot being substantially equal to the overall axial dimension of said plurality of bipolar electrodes and the cell having an electrolyte outlet located radially outwardly of the bipolar electrodes and comprising at least one generally radially extending outlet pipe communicating with an aperture in the cylindrical wall surface of the casing, said outlet pipe containing a plurality of sheets of electrically insulating material disposed immediately downstream of the bipolar electrodes in planes parallel to respective ones of said bipolar electrodes.

20. An electrolysing system including an electrolytic cell comprising a casing which has a cylindrical inner surface and which defines an electrolysing chamber, a pair of terminal electrodes located within the chamber and adapted to be connected to the poles of a D.C. source, a plurality of bipolar electrodes in the form of parallel flat annular discs which are located in the chamber between the terminal electrodes and which are rotatable about a common central axis through their centres, the outer peripheries of the bipolar electrodes lying immediately adjacent to the cylindrical inner surface of said casing, the cell having an electrolyte inlet located radially outwardly of the bipolar electrodes and comprising at least one elongate slot disposed in said cylindrical wall surface of the casing and extending in a direction generally perpendicular to the planes containing said bipolar disc electrodes, the length of said slot being substantially equal to the overall axial dimension of said plurality of bipolar electrodes, an electrolyte outlet, a dehydrogenation tank for the removal of hydrogen gas from the electrolyte, means connecting the electrolyte outlet to the dehydrogenation tank, and means for spraying liquid onto the surface of electrolyte in the dehydrogenation tank for preventing foaming of the electrolyte, the electrolyte outlet being located radially outwardly of the bipolar electrodes and comprising at least one generally radially extending outlet pipe communicating with an aperture in the cylindrical wall surface of the casing, said outlet pipe containing a plurality of sheets of electrically insulating material disposed immediately downstream of the bipolar electrodes in planes parallel to respective ones of said bipolar electrodes.

* * * * *